US009963754B2

(12) United States Patent
MacRae

(10) Patent No.: US 9,963,754 B2
(45) Date of Patent: May 8, 2018

(54) LONG CAMPAIGN LIFE STAVE COOLERS FOR CIRCULAR FURNACES WITH CONTAINMENT SHELLS

(71) Applicant: Allan J. MacRae, Hayward, CA (US)

(72) Inventor: Allan J. MacRae, Hayward, CA (US)

( * ) Notice: Subject to any disclaimer, the term of this patent is extended or adjusted under 35 U.S.C. 154(b) by 0 days. days.

(21) Appl. No.: 15/815,343

(22) Filed: Nov. 16, 2017

(65) Prior Publication Data

US 2018/0073090 A1 Mar. 15, 2018

(51) Int. Cl.

| | |
|---|---|
| ***C21B 7/10*** | (2006.01) |
| ***F27D 1/00*** | (2006.01) |
| ***F27B 1/14*** | (2006.01) |
| *F28D 21/00* | (2006.01) |
| *F27D 9/00* | (2006.01) |

(52) U.S. Cl.

CPC ..... *C21B 7/10* (2013.01); *F27B 1/14* (2013.01); *F27D 1/004* (2013.01); *F27D 2009/0027* (2013.01); *F27D 2009/0067* (2013.01); *F28D 2021/0056* (2013.01); *F28D 2021/0078* (2013.01)

(58) Field of Classification Search

CPC ..... F27D 1/12; F27D 1/004

USPC ..... 266/193, 194

See application file for complete search history.

(56) References Cited

U.S. PATENT DOCUMENTS

2013/0008636 A1* 1/2013 Smith ..... C21B 7/106 165/169

2015/0377554 A1 12/2015 Smith

FOREIGN PATENT DOCUMENTS

WO WO-2017139900 A1 * 8/2017 ..... B01J 19/02

* cited by examiner

*Primary Examiner* — Scott Kastler

(74) *Attorney, Agent, or Firm* — Richard Brewster Main; Main Law Cafe

(57) ABSTRACT

The campaign lives are extended and the risks of process gas leaks past seals are reduced by improved stave coolers that each hang together inside steel shelled furnaces by a single neck extended out through a steel jacketed collar. All the coolant circuits inside the stave cooler are collected and grouped together to pass inside through the one collar. The steel in the collar is matched to the steel used in the containment shell, and a matching steel weld seals them together. Thermal stresses are thereby prevented from accumulating over separation distances as a consequent of the steel's coefficient of expansion. A single point of penetration has no separation distance to another.

15 Claims, 4 Drawing Sheets

Fig. 3A
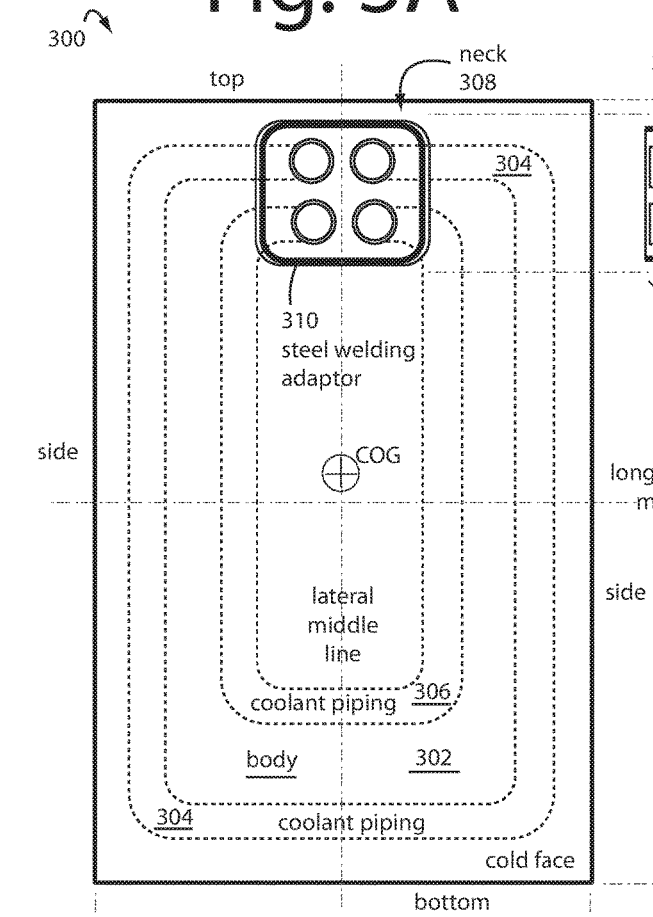
Fig. 3B
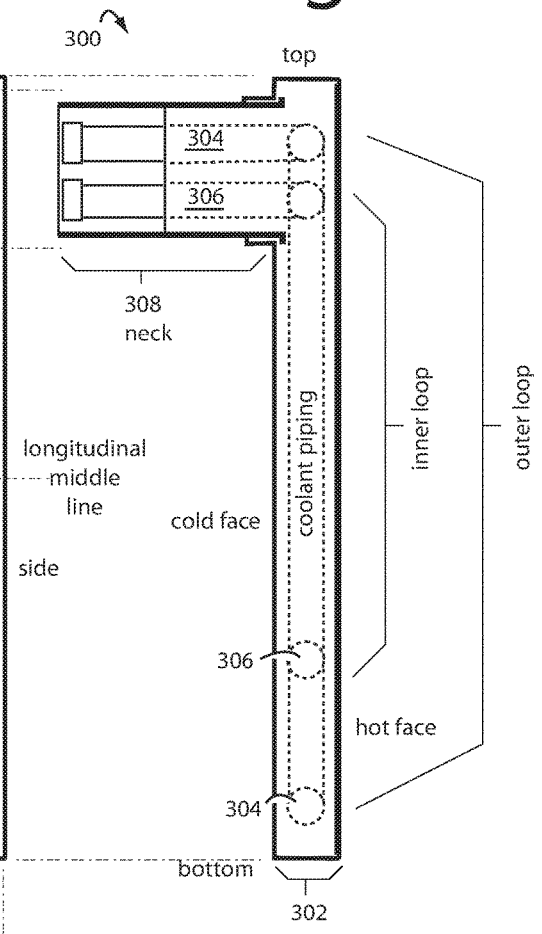
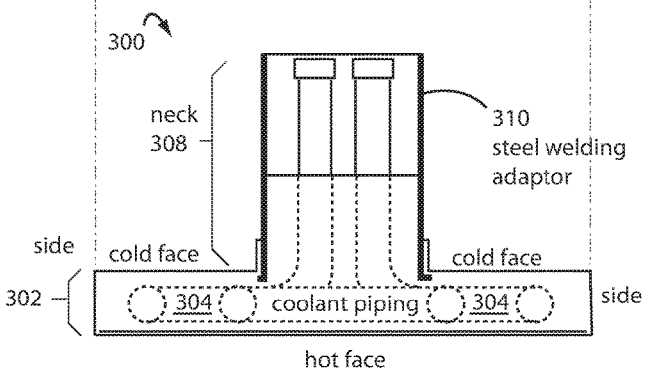
Fig. 3C

LONG CAMPAIGN LIFE STAVE COOLERS FOR CIRCULAR FURNACES WITH CONTAINMENT SHELLS

FIELD OF INVENTION

The present invention relates to stave coolers for circular furnaces with steel containment shells, and more particularly to long-campaign-life high-performance cast-iron and cast-copper stave coolers used with circulating liquid coolants to cool the vertical inside walls lining smelting furnaces.

BACKGROUND

Production rates exceeding three tons of hot metal per cubic meter of working volume per day can now be reached with modern blast furnaces. This was made possible by using improved burden materials, better burden distribution techniques, tighter process controls, very high hot-blast temperatures, oxygen enrichment technology, pulverized-coal injection, and natural gas fuel enrichment. All of which result in much higher average heat loads and fluctuations that would otherwise land inside on the steel containment shells of up-to-date blast furnaces if it were not for stave coolers.

Integrated steelworks use blast furnaces to supply themselves the pig iron they use to make steel. The large gains being made in furnace-productivity have also placed overwhelming demands on cooling system capacities. Liquid cooled stave coolers for blast furnaces were first developed in the late 1960's. Pure copper stave coolers have been used since the late 1970's to thermally insulate the outer steel containment shells of blast furnaces from the intense process heats now being generated in state-of-the-art, high stress furnaces. Copper stave coolers are also capable of delivering furnace campaign lives that now exceed fifteen years.

Where each stave cooler must be positioned within a blast furnace will be a primary determiner of the average thermal load levels it will be subjected to. Cast-iron staves can be successfully used in the less demanding middle and upper stack areas of blast furnaces, but the much higher average heat loads below in the lower stack, Belly, Bosh, Tuyere Level, and Hearth all require the use of higher performing, but more costly copper staves. See FIG. 1.

Cast iron staves are less efficient at cooling than are copper staves because the cast iron metal is relatively much lower in thermal conductivity. Steel pipes in cast iron staves are often coated with material that help with metal bonding. Otherwise, cracks in the cast iron can propagate into the steel pipes. Cast iron staves will also self-generate an insulating layer during operation that acts as a thermal barrier between its internal water-cooling tubes and the cast iron stave body. Both effects reduce the overall heat transfer abilities of cast iron staves.

Such inefficiencies in heat transfer pile up significantly higher cast iron stave hot face temperatures, e.g., over 700° C. Thermal deformations in cast iron staves are hard to avoid when they are overstressed this way. Cast iron stave bodies are further subject to phase-volume transformations when operated at very elevated temperatures. Fatigue cracking, stave body material spalling, and cooling pipes exposed directly to the furnace heat are common failures.

One stave cooler I worked on with Todd Smith is described by him in United States Published Patent Application US-2015-0377554-A1, dated Dec. 31, 2015. Such relates to a "stave comprising an outer housing, an inner pipe circuit comprising individual pipes housed within the outer housing, wherein the individual pipes each has an inlet end and an outlet end and wherein each pipe may or may not be mechanically connected to another pipe, and a manifold, integral with or disposed on or in the housing; wherein the inlet and/or outlet ends of each individual pipe is disposed in or housed by the manifold. The manifold may be made of carbon steel while the housing may be made of copper." He further adds, "Each of the inlet and outlet ends of each individual pipe may be surrounded in part by cast copper within a housing of the manifold."

When liquid cooled stave coolers are disposed inside the steel containment shells of smelting furnaces, each conventional coolant connection must have a corresponding penetration or access window in the shell in order to complete the hose connections outside. And, conventionally, each stave cooler must be bolted to or otherwise mechanically attached to the steel containment shell to provide vertical support to itself and the refractory brick lining it cools.

The hot smelting inside the furnaces produces very hot, toxic, and flammable process gases that will find escape paths between the refractory bricks, and between the stave coolers and out through any openings in the containment shell. So these penetration points must have good gas seals. One penetration is easier to seal and keep sealed than several.

But because the stave coolers, containment shells, and refractory brick are all subject to thermal expansion forces, the gas seals can be compromised by constantly being worked back and forth. Stave coolers like those described by Todd Smith, have two or more independent circuits of coolant piping inside, and each produces two coolant connection ends that must passed out back and through the containment shell.

Todd Smith describes a "manifold" that can be made of carbon steel on the back of a housing that may be made of copper. He points out that his stave 100 provides for ease of installation since it reduces the number of access holes or apertures required in the furnace shell 51 necessary for the inlet/outlet piping 108 to and from 100 through furnace shell 51. And he says, at paragraph [0094], that stave 100 is of very strong construction to provide much of the support necessary for installation of the stave 100 on furnace shell 51. The effects of stave expansion/contraction due to temperature changes in the furnace are minimized since individual pipe connections to furnace shell have been eliminated. And, stave 100 reduces weld breaches in pipe connections with furnace shell 51 since such connections have been eliminated. Todd Smith says further that his stave 100 reduces the importance/criticality of any support bolts needed to help support stave 100 on furnace shell 51 since such bolts are no longer relied upon to independently support stave 100 since manifold 106 carries much of the load required to support stave 100 on furnace shell 51.

What has proved to be needed by the industry is a stave cooler that has one-only through-bulkhead always collared in steel, and through which all coolant piping passes from two or more independent coolant circuits in a single rectangular copper body through in a group and connect externally outside the steel containment shell. And which stave coolers depend entirely for their vertical mechanical support by a single hanging of the through-bulkhead in a single corresponding penetration of the containment shell. The effects of stave expansion/contraction due to temperature changes in the furnace must be minimized by tightly grouping the individual pipe connections through the furnace shell to limit the linear ranges possible.

SUMMARY

Briefly, cast-iron and cast-copper stave cooler embodiments of the present invention improve the campaign lives of vertically orientated metal smelting or converting furnaces in which at least a portion of its steel shelled vessel is cylindrical. Each such stave cooler has a single flat or curved rectangular body with one-only protruding neck that includes a steel collar adaptor. It is this one through-bulkhead which all the coolant piping passes in a group from two or more independent coolant circuits inside the stave body. These circuits then individually connect externally outside the steel containment shell. Such stave coolers are configured to depend entirely for all their vertical mechanical support on a single hanging of the protruding neck as a through-bulkhead in a single corresponding penetration of the containment shell. Thus, a single annular welded steel-to-steel gas seal around the through-bulkhead is all that's needed inside the steel containment shell for each stave cooler. All the coolant piping circuits are laid flat in a single common layer, and all proximate and parallel inside to a hot face. The cast-copper stave cooler hot faces are dressed with an abrasion resistant layer that extends campaign lives beyond ten years.

SUMMARY OF THE DRAWINGS

FIGS. 3A-3C are cold face, side, and bottom edge view diagrams of a stave cooler embodiment of the present invention.

DETAILED DESCRIPTION OF THE EMBODIMENTS

Iron smelting furnaces operate in highly reducing environments and produce dangerous levels of toxic and highly flammable carbon monoxide (CO) gas. Carbon monoxide is a colorless, odorless, and tasteless gas that is slightly less dense than air. It is toxic to hemoglobic animals when encountered in concentrations above about 35-ppm. Carbon monoxide is produced from the partial oxidation of carbon-containing compounds. It forms when there is not enough oxygen to produce carbon dioxide ($CO_2$), such as when smelting carbon steel. Even in the presence of atmospheric concentrations of oxygen, carbon monoxide burns with an invisible blue flame, producing carbon dioxide.

It is therefore very important to control and stop errant carbon monoxide process gases that force through gaps between stave coolers, cracks in the castable refractory cement, and seals welded into the steel containment shells at the coolant connections and stave support fasteners.

Copper is highly preferred over cast iron for stave coolers because the thermal conductivity of copper is so much better than cast iron. But copper is relatively soft and easily abraded, compared to cast iron. The churning and roiling of the "coke" inside a furnace is highly abrasive to the walls, especially in the upper reaches. Copper stave coolers must therefore have some sort of abrasion resistant facing incorporated into their hot faces if they are to survive in a campaign that extends ten years or more.

Figure 1:
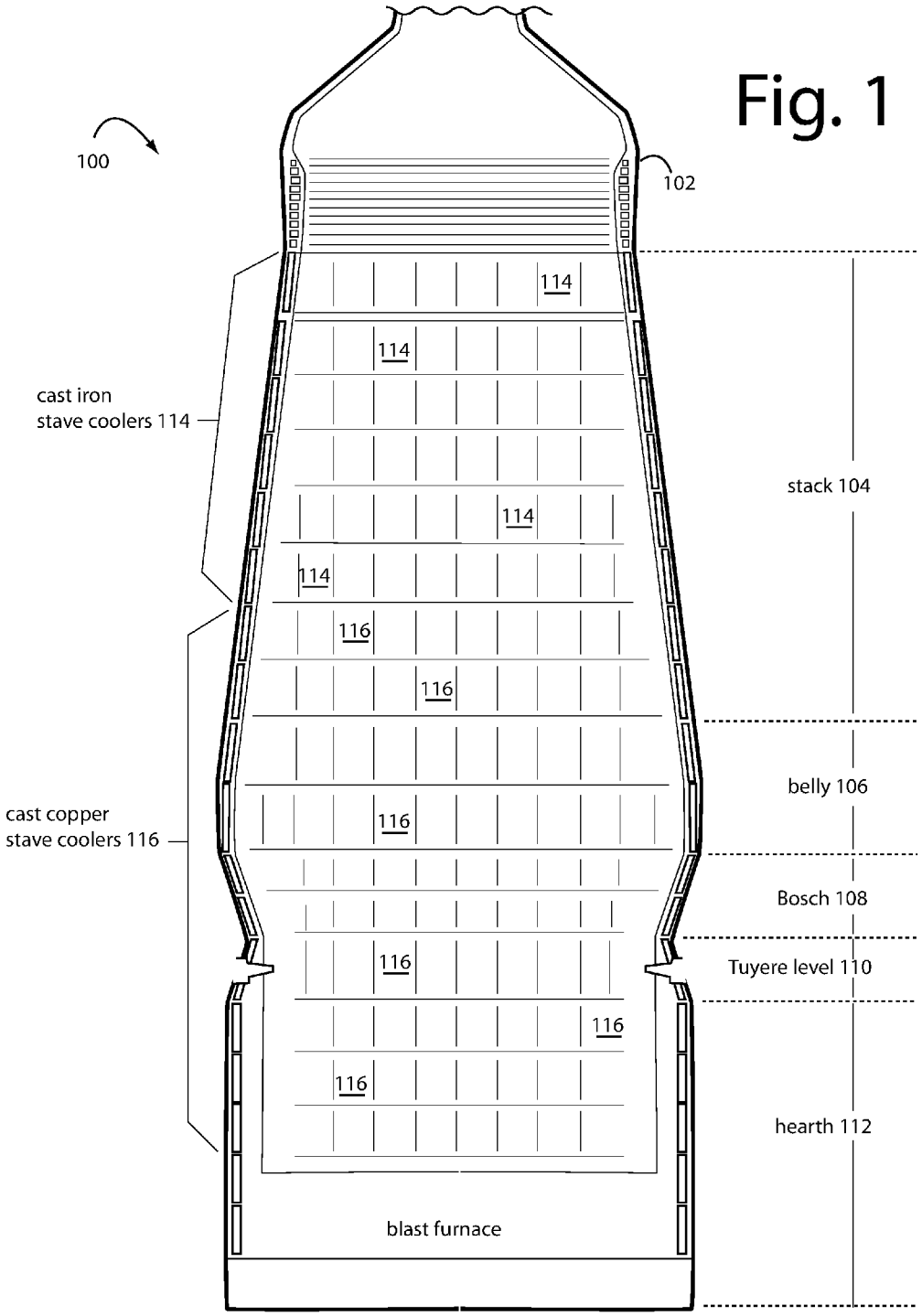
FIG. 1 is a cross sectional view diagram of a vertically orientated metal smelting or converting furnace embodiment of the present invention with a steel containment shell that has only one penetration per stave cooler for liquid coolant circulation.

FIG. 1 represents a typical blast furnace 100 in which various stave cooler embodiments of the present invention have been installed. In reduction smelting, the ore is reduced by carbon in the presence of flux to yield molten metal and slag. The typical blast furnace 100 includes a steel containment shell 102 with several zones of operation inside: a stack 104, a belly 106, a Bosch 108, a Tuyere level 110, and a hearth 112. Average operating temperatures in the lower stack 104 and below are much higher, and more demanding on stave coolers than the middle stack 104 and above.

A cast iron stave cooler embodiment of the present invention is therefore used in the middle stack 104 and above with liquid cooling. Such cast iron stave coolers are referred to herein by the general reference numeral 114. Cast iron material offers superior abrasion resistance, but is not as thermally conductive as copper.

A cast copper stave cooler embodiment of the present invention is therefore used in the lower stack 104 and below with liquid cooling. Such cast copper stave coolers are referred to herein by the general reference numeral 116. Copper material offers superior thermal conductivity, but is easily abraded by the agitation and churning of the coke inside the furnace, and therefore must include an abrasion resistant facing incorporated into the entire outside surface area of the hot faces of each cast copper stave cooler.

Figure 2:
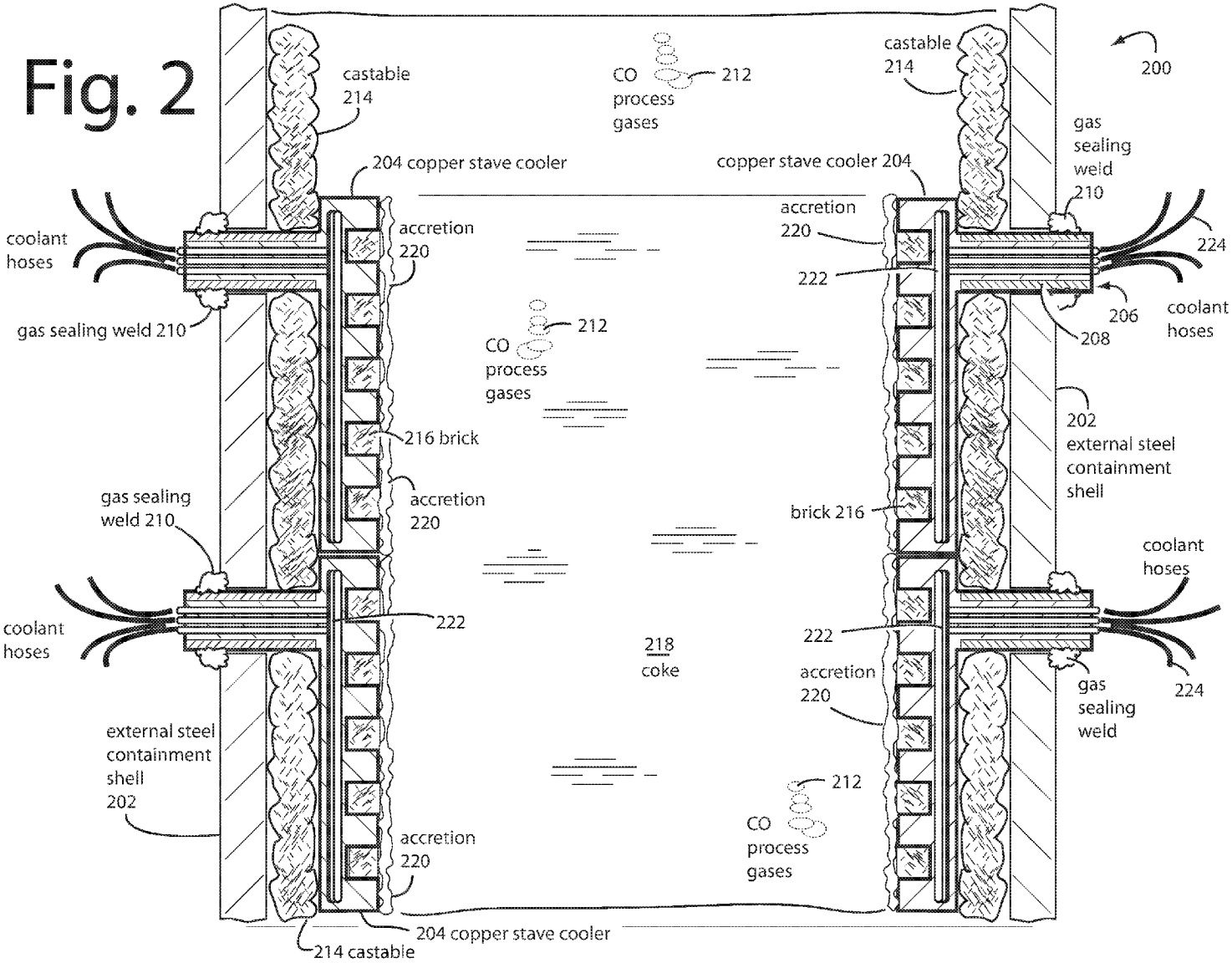
FIG. 2 is a cross sectional view diagram of a middle section of a furnace like that of FIG. 1, and represents the way stave cooler embodiments of the present invention seal out the escape of process gases with steel-to-steel welds around the steel collar adaptors on the protruding necks, and have castable refractory cement packed in behind them. The steel containment shell is penetrated only once per stave cooler, and all piping for liquid coolant circulation is gathered together in a single group to pass through the protruding necks inside their respective steel collar adaptors.

FIG. 2 represents a section of an iron-smelting furnace 200 in an embodiment of the present invention that uses either cast iron stave coolers 114 (FIG. 1), or cast copper stave coolers 116. The insides of an external steel containment shell 202 are lined with copper stave coolers 204. These each have a single protrusion 206, and each such protrusion 206 is jacketed in a steel-to-steel welding collar adaptor 208.

An annular steel-to-steel weld 210 is thus made possible that will secure the mounting of each copper stave coolers 204 and that will prevent the uncontrolled escape of process gases 212. A castable refractory cement 214 is packed in behind each copper stave cooler 204 in front of the inside walls of the steel containment shell 202, also to prevent the uncontrolled escape of process gases 212.

Cast copper stave coolers require an abrasion resistant facing or layer incorporated into their hot faces if their campaign lives are to exceed ten years. Cast iron stave coolers do not because the cast iron itself is very wear resistant.

The hot faces of the copper stave coolers 204 can therefore be finished in a number of different ways to limit erosion caused by abrasion with a typical smelting furnace coke 218. A conventional way is to horizontally groove the hot faces to retain rows of refractory brick, castable refractory cement, or cast iron metal inserts. In alternative embodiments, the hot faces include a weld overlay or spray coating of abrasion resistant metal or ceramic. For example, nickel and chromium for the metals. And silicon dioxide for the ceramic.

FIG. 2 simplifies the illustration of a range of abrasion resistant facing types by simply showing rows of refractory bricks 216 inserted into horizontal grooves on the hot faces. Such bricks would ordinarily continue over to cover the copper lips of the grooves. Alternatively, the entirety of the hot faces of the stave coolers are deeply dimpled or pocketed to better retain castable refractory cement, instead of conventional grooving or slotting.

Smelting furnace coke 218 will form a layer of accretion 220 as it chills on the hot faces of the copper stave coolers 204. Such accretion includes condensed gases, slag, and metal. An internal arrangement of liquid coolant piping 222 inside the copper stave coolers 204 are all routed in a single group for connection with hoses 224 outside the steel containment shell 202. They all pass through respective single protrusions 206.

Conventional drilled billet block type of stave cooler fabrication is not a practical alternative embodiment of the present invention because too much drilling and plugging is required to get all the internal coolant passageways to begin and end in a single group within the single protrusion 206 (inside steel-to-steel welding collar adaptor 208).

Iron-smelting furnaces that use liquid cooled copper stave coolers inside steel containment shells can leak carbon monoxide gas through the penetrations in the containment shell provided for the many liquid coolant connections. These penetrations need to be sealed, and the seals must stay tight over the campaign life of the furnace. The carbon monoxide gas itself is very toxic, it's odorless, colorless, and can burn very hot in ordinary air with an invisible flame.

In one liquid cooled stave cooler embodiment of the present invention for smelting furnaces with steel containment shells, a solid copper stave body is cast in a flattened and rectangular shape. They may also be curved slightly to fit better in upright, cylindrical and round furnaces. These stave coolers are typically about 2.5 meters tall, 1.0 meter wide, and 120 mm thick. So in general, embodiments like liquid cooled stave coolers 114, 116, and 204 are substantially taller than they are wide, and are substantially wider than they are thick.

FIGS. 3A-3C represent a cast copper cooler stave 300 in a typical embodiment of the present invention. All corners and edges are finished eased and rounded. (Sharp edges concentrate mechanical stresses in the castable refractory cement.) A copper body 302 is cast over two or more preformed and pre-shaped independent circuits of coolant piping 304 and 306. A single, protruding neck 308 is collared completely by a steel-to-steel welding adapter 310.

Actually, since the steel-to-steel welding adapter 310 is made of steel, and the copper body 302 and neck protrusion are copper, the two will not be bonded together very well by a steel-to-copper weld. A much more secure and gas tight attachment is needed. So the steel-to-steel welding adapter 310 is preferably embedded into the copper during casting of the copper body 302 and neck protrusion. See FIG. 4. The great weight of copper stave cooler falls entirely on the steel-to-steel welding adapter 310, and so the two must never separate. The embedded end of steel-to-steel welding adapter 310 can have its edges turned out to mechanically "lock" into the copper casting. Another way to mechanically lock the steel-to-steel welding adapter 310 firmly into the cast copper in the stem of neck 308 and body 302 is to predrill several holes through the bottom walls of the steel-to-steel welding adapter 310 such that during the casting illustrated in FIG. 4 the molten copper will flow into the holes and freeze.

Turning now to the problem of sealing necks 308 to their corresponding penetrations in the steel containment shells, neither cast iron nor cast copper stave coolers would weld very well directly, without the steel-to-steel welding adapter 310, because of metal dissimilarities. E.g., cast iron to steel, or cast copper to steel. But, good welds outside the containment shell are mandatory to stop the escape of errant process gases and to mechanically support and secure the stave cooler to the containment shell.

An so all stave coolers must be "adapted" to be able to be welded to the steel of containment shells 102, 202.

The copper casting in the neck 308 is a continuous part of the copper casting of the body 302. Such copper casting in the neck 308 may not completely fill the spaces inside the distal end of the steel-to-steel welding adapter 310. And so the spaces can be stuffed with a packing material to deal with errant process gases that get inside neck 308.

FIGS. 3A-3C terminate all the independent circuits of coolant piping 304 and 306 with pipe fittings, e.g., within neck 308. These then are externally connected with flexible coolant hoses 224 (FIG. 2) outside steel containment shell 202.

The placement and orientation of neck 308 on the cold face of body 302 is critical. The neck 308 provides the only vertical support of stave cooler 300 on the inside of containment shell 102, 202. It should hang straight like a picture frame does on a single hook on a wall, as in FIG. 3A. However, with respect to FIG. 3B, it may be necessary for the top edge to tilt in or out toward the inside of containment shell 102, 202, relative to the bottom edge, in order to fit the inside contours of the furnace.

A number of bolts may be disposed on the backside for connection to or contact with the steel containment shell, and these can help secure any top or bottom forward tilt of the liquid cooled stave cooler away from its otherwise hanging straight and vertical with respective to FIG. 3B.

The stave cooler 300, as seen in FIG. 3A, will hang the straightest if neck 308 is disposed close to the top edge and straddles an imaginary lateral middle line. If the construction of stave cooler 300 is symmetrical about this imaginary lateral middle line, its center of gravity (COG) will be bisected.

Neck 308 and steel-to-steel welding adapter 310 are shown in FIGS. 3A-3C as nearly square with rounded corners. But they can also be configured in the shape of a cylindrical "can". The corresponding penetrations provided in the steel containment shells 102, 202, would of course have to be round. Special casting and fabrication methods may be needed to construct copper cast stave coolers 300.

Figure 4:
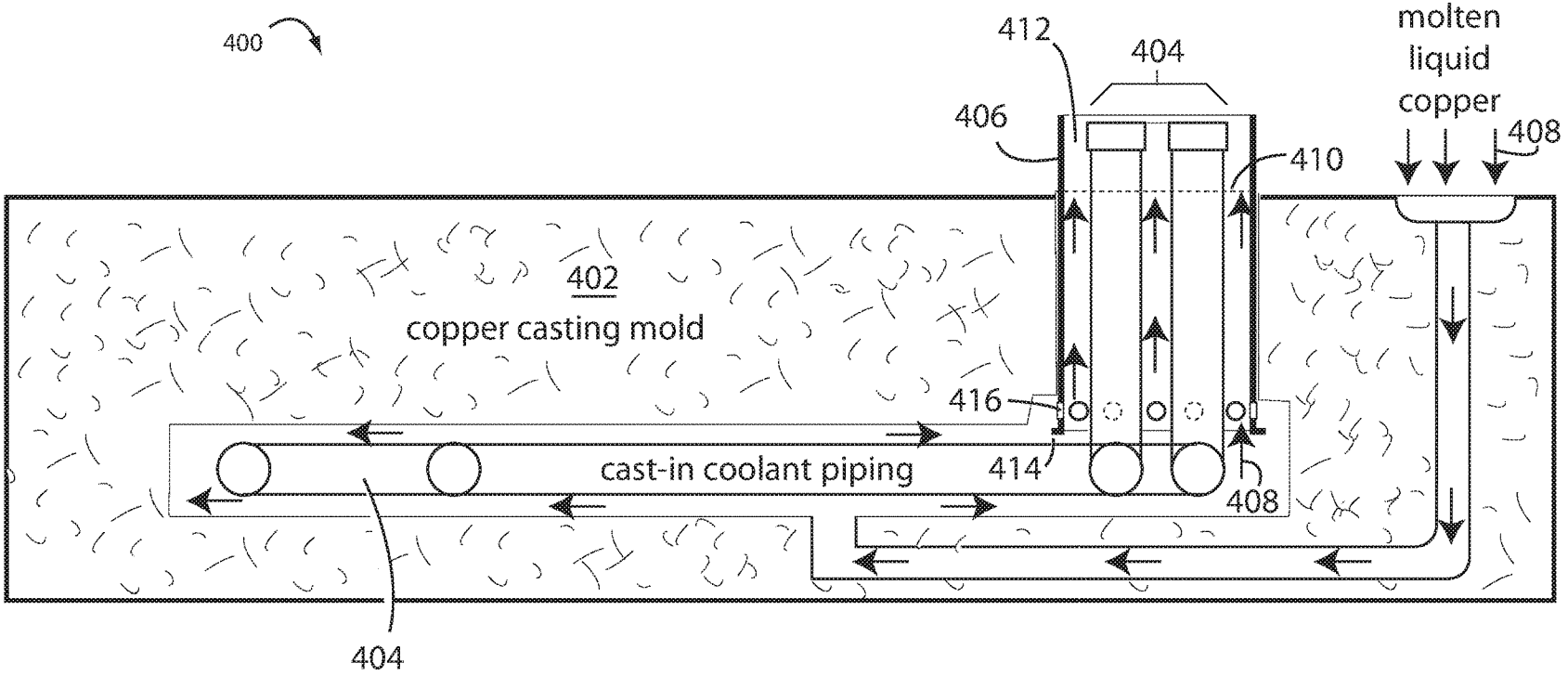
FIG. 4 is a cross sectional diagram of a copper casting mold useful in making the stave coolers of FIGS. 1, 2, 3A, 3B, and 3C.

FIG. 4 represent a method 400 for casting and fabricating, for example, copper cast stave coolers 300. Copper casting methods are both ancient and well known. Therefore many of the conventional details of copper casting need not be described here.

A mold 402 is split open to receive a network 404 of pre-shaped and pre-formed pipes and fittings. A steel-to-steel welding collar adaptor 406 is prepositioned inside of the top of mold 402, and enclosing the coupling ends of pipe network 404.

Mold 402 is positioned flat and level with steel-to-steel welding collar adaptor 406 pointing up and proud of the mold. A molten liquid flow of copper 408 is desired to come up and rise gently and evenly from under the center. Feeding from the edges would promote one sided shrinkage. The pour rises up inside and around to embed the steel-to-steel welding collar adaptor 406 and completely immerse and bond with pipe network 404. The pour is continued up to a particular level 410, and then the whole allowed to cool slowly and solidify.

A pure crystalline formation of the copper during casting is not preferred because such copper castings will not bond well with the coolant piping. A small grain copper is best, but not at the expense of electrical conductivity quality control measures that fall below a minimum of 80% of International Annealed Copper Standard (IACS). (Thermal conductivity tracks electrical conductivity, and electrical conductivity is simple and easy to measure in manufacturing.)

The best performance under high average heat loads in stave cooler use in smelting furnaces requires a balance of factors like molten metal heat, cooling rate after the pour, alloys added to improve strength and control grain sizes, deoxidants, optimized pipe bonding with the casting, and not falling below an electrical conductivity of 80% IACS so the thermal conductivity will be relatively free of the thermal resistance and gradients that plague cast iron.

An open space 412 may be deliberately left inside the top distal half of steel-to-steel welding collar adaptor 406. The embedded end of steel-to-steel welding adapter 406 should have its bottom edges 414 turned out all around to mechanically "lock" into the copper casting once it cools and freezes in.

Some method embodiments of the present invention go further to mechanically lock the steel-to-steel welding adapter 406 firmly into the cast copper in the stem of neck 308 and body 302 (FIGS. 3A-3C). Several holes 416 are drilled through the bottom walls of the steel-to-steel welding adapter 406 before casting it in the copper of method 400. The molten copper 408 will flow into and through the holes 416 and freeze into several fingers.

The steel-to-steel welding collar adaptors here should have a tight seal with the protruding necks. (To prevent errant escaping process gases.) A practical way to construct these steel-to-steel welding collar adaptors is to use a length of structural steel tubing with rounded corners and no seams or welds. Large diameter round pipe is also possible. Preferably, the steel used in the structural steel tubing comprises a type of steel that has a thermal coefficient of expansion that matches the thermal coefficient of expansion of the steel of which the steel containment shell is comprised.

The casting of copper inside a steel-to-steel welding collar adaptors of carbon steel may not result in a clean joint between the two. It may be better to use stainless steel here for the collar if that is a problem. The level of liquid molten copper that is flooded into the steel-to-steel welding collar adaptor from below during casting can be limited to filling the bottom half only. The inside of the top half can be stuffed later with some suitable packing to prevent errant escaping process gases.

Each liquid cooled stave cooler embodiment includes at least two independent circuits of coolant piping all of which are disposed as flat loops in a single common layer. One loop can often be laid flat inside another loop. All such independent circuits of coolant piping are arranged inside the solid copper stave bodies to be uniform, parallel, and proximate to the insides of the hot faces.

Each end of each independent circuit of coolant piping are all turned up together in a single group inside and through both the protruding neck and inside the steel-to-steel welding collar adaptor. This requirement will frustrate drilling in billet methods because too many plugs become necessary to be practical.

In general, a liquid cooled stave cooler for smelting furnaces with steel containment shells comprises a single, copper casting of a stave body that is rectangular in shape with a top edge, a bottom edge, left and right side edges, a hot face, and a cold face. Each such stave body is substantially taller than it is wide, and that is substantially wider than it is thick. It is configured to be cemented to the inside of a steel containment shell of a smelting furnace, e.g., to seal out process gases.

There are at least two independent circuits of coolant piping all of which are cast into the stave body as flat loops in a single layer and arranged to be uniform, parallel, and proximate to the inside of the hot face.

An abrasion resistant facing is often incorporated into the entire outside surface area of the hot face of copper stave coolers. A shield material with a higher abrasion resistance than copper to the churning and roiling of coke is needed inside a furnace. It is placed to environmentally protect the copper casting of the stave body. If a copper stave coolers is not protected with an abrasion resistant facing, then the copper stave cooler must be sufficiently liquid cooled to always chill and maintain for itself a protective layer of frozen accretion on its hot face.

Copper stave cooler embodiments of the present invention will therefore invariably have a single, protruding elongated neck of the single copper casting is disposed proximate to the middle of the top edge and on the cold face of the stave body. It is configured to vertically support the entire weight of the liquid cooled stave cooler within the steel containment shell from a single penetration. A steel-to-steel welding collar adaptor completely jackets the end of the protruding elongated neck. Such preferably comprises a prefabricated material similar to structural steel tubing having rounded corners and no seams or welds.

Every stave cooler embodiment of the present invention will therefore always have a steel-to-steel welding collar adaptor made of a type of steel with a thermal coefficient of expansion that substantially matches the thermal coefficient of expansion of the type of steel of which a steel containment shell is comprised. Each end of each independent circuit of coolant piping are all turned up together in a single group inside and through the protruding elongated neck jacketed by the steel-to-steel welding collar adaptor.

Some stave cooler embodiments of the present invention will include an abrasion resistant facing incorporated into the entire surface area of the hot face can include a number of horizontal and parallel grooves cast into the solid copper stave body to retain one of refractory brick, castable refractory cement, and cast iron metal inserts.

These abrasion resistant facings may alternatively include a grid pattern of deep rectangular surface pockets or dimples cast into the solid copper stave body to retain castable refractory cement.

Any abrasion resistant facing incorporated into the entire surface area of the hot face may further alternatively include a deposited layer of nickel on copper material, and a deposited layer of chromium on the nickel.

The correct tilting and angular set of heavy stave coolers inside the containment seals into wet castable refractory cement can be assisted by placing a number of bolts on their backsides as spacers to the steel containment shell. While the castable refractory material sets up during construction, these devices can maintain the tilt of the liquid cooled stave cooler it would assume otherwise.

But in every embodiment, an annular steel-to-steel weld of matching types of steel is required between the outside of the steel-to-steel welding collar adaptor and the inside of a corresponding penetration of the steel containment shell. The critical advantage of making a good gas seal during construction and then maintaining later over the campaign life is process gases are prevented from escaping from the inside of the steel containment shell and injuring personnel or damaging equipment. Limiting to one penetration, and avoiding metal stress concentrations from material mismatches are avoided. Such reasons have been the cause failures of conventional seals, especially over long time periods of use.

Invariably, the independent circuits of coolant piping used in copper stave cooler embodiments comprise pipes tubing cast in liquid molten copper inside a mold which was flooded from the bottom. The liquid molten copper is allowed to slowly rise up and slowly cool inside the steel-to-steel welding collar adaptor.

As is conventional, a number of rows of parallel and horizontal grooves may be alternatively disposed on the entirety of the hot face. These assist in an attachment of refractory bricks or castable refractory cement.

Generally, all the outside corners and edges of stave cooler embodiments of the present invention are finished to be eased and rounded. Such assures that fewer thermal stresses will be imposed on any castable refractory cement in contact with such points.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A liquid cooled stave cooler for smelting furnaces with steel containment shells, comprising:

a single, copper casting of a stave body that is rectangular in shape with a top edge, a bottom edge, left and right side edges, a hot face, and a cold face, wherein such stave body is substantially taller than it is wide, and that is substantially wider than it is thick, and that is shaped with a single point of penetration and mounting to the inside of a wall of a steel containment shell of a smelting furnace;

at least two independent circuits of coolant piping all of which are cast into the stave body as flat loops in a single layer and arranged to be uniform, parallel, and proximate to the inside of the hot face, wherein all said independent circuits of coolant piping have their respective ends collected together in a single group in the single point of penetration and mounting of the stave body;

a single, protruding elongated neck of the single copper casting is disposed proximate to the middle of the top edge and on the cold face of the stave body to serve as the single point of penetration and mounting, and is configured to vertically support the entire weight of the liquid cooled stave cooler within the steel containment shell;

a steel-to-steel welding collar adaptor that completely jackets the end of the protruding elongated neck, and that comprises steel, and further comprising a type of steel with a thermal coefficient of expansion that substantially matches the thermal coefficient of expansion of the type of steel of which a steel containment shell is comprised; and wherein, each end of each independent circuit of coolant piping are further all turned up together in a single group inside and through the protruding elongated neck jacketed by the steel-to-steel welding collar adaptor.

2. The liquid cooled stave cooler of claim 1, further comprising:

an abrasion resistant facing incorporated into the entire surface area of the hot face that also includes a number of horizontal and parallel grooves on the face of the solid copper stave body to retain at least one of refractory brick, castable refractory cement, and cast iron metal inserts.

3. The liquid cooled stave cooler of claim 1, further comprising:

an abrasion resistant facing incorporated into the entire surface area of the hot face that also includes a grid pattern of surface pockets cast into the solid copper stave body to retain a castable refractory cement.

4. The liquid cooled stave cooler of claim 1, further comprising:

an abrasion resistant facing incorporated into the entire surface area of the hot face that also includes a deposited layer of nickel on copper material, and a deposited layer of chromium on the nickel.

5. The liquid cooled stave cooler of claim 1, further comprising:

a number of bolts disposed on a backside of the stave body for connection to or contact with the steel containment shell, and that secure any tilt of the liquid cooled stave cooler away from its otherwise hanging straight and vertical.

6. The liquid cooled stave cooler of claim 1, further comprising:

an annular steel-to-steel weld of a matching type of steel between the outside of the steel-to-steel welding collar adaptor and the inside of a corresponding penetration of the steel containment shell, wherein process gases are prevented by a completed weld from escaping from the inside of the steel containment shell, and stress concentrations are avoided that can cause failures of the seal over time.

7. The liquid cooled stave cooler of claim 1, wherein the independent circuits of coolant piping comprise a metal tubing cast in a liquid molten copper inside a mold which was flooded from the bottom such that liquid molten copper rises up inside the steel-to-steel welding collar adaptor and froze.

8. The liquid cooled stave cooler of claim 1, wherein all outside corners and edges of the stave body, single point of penetration and mounting, and welding collar adaptor are eased and rounded such that fewer thermal stresses are imposed on any castable refractory cement that may be in mechanical contact with them.

9. The liquid cooled stave cooler of claim 1, wherein:

the stave body comprises a casting of liquid molten copper flooded from beneath inside a mold; and the independent circuits of coolant piping comprise tubing that was laid inside the mold before the liquid molten copper was flooded inside the mold.

10. The liquid cooled stave cooler of claim 1, wherein:

the stave body comprises a solid billet of copper; and the independent circuits of coolant piping comprise a number of connecting passages drilled into the solid billet of copper and that are then capped with plugs.

11. The liquid cooled stave cooler of claim 1, wherein a center of gravity for the whole liquid cooled stave cooler occurs equidistant to each of a pair of lateral sides, as does a center point of the steel-to-steel welding collar adaptor that is located apart from the center of gravity and substantially nearer the top.

12. A liquid cooled stave cooler for smelting furnaces with steel containment shells, comprising:

a cast iron stave body for cooling a portion of a lining inside a smelting furnace with a cylindrical steel containment shell;

a single, protruding squared or round neck mid-laterally disposed on a cold face of the cast iron stave body configured for the whole liquid cooled stave cooler to be hung from a single matching penetration for it inside the steel containment shell;

a squared or round steel-to-steel welding collar adaptor inside which the protruding squared or round neck is disposed, and comprising a steel having a thermal coefficient of expansion that matches the thermal coefficient of expansion of the steel of which the steel containment shell is comprised; and a least two independent circuits of coolant piping all of which are disposed as loops in a single layer, and where at least one loop is flat inside another loop, and all of which independent circuits of coolant piping are laid inside the cast iron stave body and are flat, parallel, and proximate to the inside of the hot face;

wherein, each end of each independent circuit of coolant piping are all turned up together in a single group inside and through both the protruding neck and inside the steel-to-steel welding collar adaptor.

13. The liquid cooled stave cooler of claim 12, wherein the cast iron stave body is rectangular in shape, and is substantially taller than it is wide, and is substantially wider than it is thick, and includes a hot face for cooling a lining of refractory brick or castable refractory cement inside a smelting furnace, and further includes a backside opposite to the hot face for contacting the inside of a cylindrical steel containment shell of a round smelting furnace.

14. The liquid cooled stave cooler of claim 12, wherein a center of gravity for the whole liquid cooled stave cooler occurs equidistant to each of a pair of lateral sides, as does a center point of the squared or round steel-to-steel welding collar adaptor is located apart from the center of gravity and substantially nearer the top.

15. A liquid cooled stave cooler, comprising:

a body of cast copper alloyed to balance its thermal conductivity, pipe bonding, strength, and small grain properties with an electrical conductivity of not less than 80% of International Annealed Copper Standard (IACS);

a single protruding squared or round neck of the body of cast copper configured and positioned on a cold face of the liquid cooled stave cooler to provide substantially all of the vertical support of the liquid cooled stave cooler when hung inside from a matching penetration of a steel containment shell of a furnace;

a squared or round steel-to-steel welding collar adapter cast into, embedded, and bonded with both the single protruding squared or round neck and a base area of the body of cast copper surrounding the single protruding squared or round neck; and a network of liquid cooling pipes disposed in a common single layer pattern within the body of cast copper between the cold face and a hot face, and having all its respective ends of pipes turned up and gathered together in a single group that pass through both the squared or round steel-to-steel welding collar adapter cast the single protruding neck for connection outside the steel containment shell.

* * * * *